US007119771B2

(12) United States Patent
Yoneda et al.

(10) Patent No.: US 7,119,771 B2
(45) Date of Patent: Oct. 10, 2006

(54) LIQUID CRYSTAL DISPLAY APPARATUS

(75) Inventors: Shuji Yoneda, Osaka (JP); Naoki Masazumi, Kobe (JP)

(73) Assignee: Minolta Co., Ltd., Osaka (JP)

( * ) Notice: Subject to any disclaimer, the term of this patent is extended or adjusted under 35 U.S.C. 154(b) by 391 days.

(21) Appl. No.: 09/993,413

(22) Filed: Nov. 5, 2001

(65) Prior Publication Data

US 2002/0057242 A1 May 16, 2002

(30) Foreign Application Priority Data

Nov. 6, 2000 (JP) ..... 2000-338095

(51) Int. Cl.
*G09G 3/36* (2006.01)

(52) U.S. Cl. ..... 345/87; 345/50; 345/51; 345/204; 345/208

(58) Field of Classification Search ..... 345/50, 345/51, 52, 87, 90, 94, 204, 205, 208, 214
See application file for complete search history.

(56) References Cited

U.S. PATENT DOCUMENTS 5,091,557 A * 2/1992 Nagai et al. ..... 560/39
5,111,297 A * 5/1992 Tsuji et al. ..... 348/565
5,172,107 A * 12/1992 Kanno et al. ..... 345/100
5,526,014 A * 6/1996 Shiba et al. ..... 345/96
5,600,455 A * 2/1997 Ishikawa et al. ..... 349/57
5,726,679 A * 3/1998 Kanno et al. ..... 345/100
5,734,367 A * 3/1998 Tsuboyama et al. ..... 345/101
5,748,277 A 5/1998 Huang et al. ..... 349/169
5,754,153 A * 5/1998 Mizutome et al. ..... 345/97
5,814,378 A * 9/1998 Onishi et al. ..... 428/1.3
6,008,787 A * 12/1999 Kondoh ..... 345/97
6,052,103 A * 4/2000 Fujiwara et al. ..... 345/89
6,184,853 B1 * 2/2001 Hebiguchi et al. ..... 345/88
6,229,515 B1 * 5/2001 Itoh et al. ..... 345/103
6,243,061 B1 * 6/2001 Sandoe et al. ..... 345/91
6,414,666 B1 * 7/2002 Yamakawa et al. ..... 345/95
6,501,454 B1 * 12/2002 Ozawa et al. ..... 345/96
6,602,563 B1 * 8/2003 Kobayashi et al. ..... 428/1.3
6,628,251 B1 * 9/2003 Ishizuka ..... 345/60

OTHER PUBLICATIONS

"23.3: High-Performance Dynamic Drive Scheme for Bistable Reflective Cholesteric Displays", X.-Y. Huang, M. Stefanov, Kent Display Systems, Kent, OH, and D.-K. Yang, J.W. Doane, Liquid Crystal Institute, Kent State University, Kent, OH, SID 96 Digest, pp. 359-362.

(Continued)

*Primary Examiner*—Bipin Shalwala
*Assistant Examiner*—Vincent E. Kovalick
(74) *Attorney, Agent, or Firm*—Sidley Austin LLP

(57) ABSTRACT

Disclosed herein is a liquid crystal display apparatus comprising: a liquid crystal display element composed of a liquid crystal layer and having a plurality of pixels arranged in a matrix pattern; and a driver for dividing one frame into plural fields and interlace-scanning the plurality of fields. In one embodiment, the driver is so structured to drive the respective fields composing one frame so that a scanning order of the fields is discontinued at least once. In another embodiment, the driver is so structured to drive scanning lines by means of a driving waveform having a reset period for resetting a state of liquid crystals, a selection period for selecting a final display state of the liquid crystals, and a maintaining period for establishing the state selected at the selection period, and starts scanning of next field based on reset period end timing of one scanning line of the previous field.

14 Claims, 8 Drawing Sheets

OTHER PUBLICATIONS

Zhu, Y.M. & Yang, D.K., "High-Speed Dynamic Drive Scheme for Bistable Reflective Cholesteric Displays," SID 97 Digest, 28, 97-100 (1997) ISSN 0097-0966X/97/2801-0097.

X.Y. Huang et al., "High-Performance Dynamic Drive Scheme for Bistable Reflective Cholesteric Displays," SID 96 Digest, 27, 359-362 (1996) ISSN 0097-0966X/96/2701-0359.

X.Y. Huang et al., "Unipolar Implementation for the Dynamic Drive Scheme of Bistable Reflective Cholesteric Displays," SID Digest of Technical Papers, 27, 899-902 (1997).

X.Y. Huang et al., "Dynamic Drive for Bistable Reflective Cholesteric Displays: A Rapid Addressing Scheme," Journal of the SID, 3/4, 165-168 (1995).

* cited by examiner

SCANNING EXAMPLE 4 (SEVEN-FIELD-SCANNING: 1→3→5→7→2→4→6)

SCANNING EXAMPLE 5 (SEVEN-FIELD-SCANNING): 1 → 4 → 7 → 2 → 5 → 3 → 6)

LIQUID CRYSTAL DISPLAY APPARATUS

CROSS-REFERENCE TO RELATED APPLICATIONS

This application is based on Japanese Patent Application No. 2000-338095 which was filed in Japan on Nov. 6, 2000, the entire content of which is hereby incorporated by reference.

BACKGROUND OF THE INVENTION

1. Field of the Invention

The present invention relates to a liquid crystal display apparatus. More specifically, the invention relates to the liquid crystal display apparatus which is provided with a liquid crystal display element composed of a liquid crystal layer having a plurality of pixels arranged in a matrix pattern.

2. Description of the Related Art

In recent years, a liquid crystal display element, which uses chiral nematic liquid crystal showing a cholesteric phase at room temperature, attracts attention as small, light weight and energy saving element since this element has a memory property for maintaining a display state even when supply of electric power is stopped.

However, in such kind of the liquid crystal display element, it is necessary to write an image after liquid crystal is once reset. For this reason, it takes longer time to complete display in comparison with TFT liquid crystal or the like, and thus such a liquid crystal display element is unsuited for display of a motion picture and an image which changes at high speed (for example, display of input characters and scrolling of screen). Moreover, while rewriting of the screen is completed, there is a problem that an optical absorption layer which is a background of the element is observed as black lines (blackout) in the portion to be rewritten and a screen is difficultly viewed.

The inventors paid an attention to the possibility that difficulty in viewing the screen is solved by driving a liquid crystal layer having a plurality of pixels arranged in the matrix pattern by means of interlace scanning where one frame is divided into a plurality of fields so as to be capable of rewriting the screen at high speed. However, it was found that when the respective fields were successively scanned to be driven, the black out portion still appeared as a stripe pattern.

SUMMARY OF THE INVENTION

It is an object of the present invention to provide a liquid crystal display apparatus which is capable of rewriting a screen at high speed as well as suppressing generation of a stripe pattern due to black out at the time of rewriting of screen as much as possible.

In order to achieve the above object, a liquid crystal display apparatus according to first aspect of the present invention comprises: a liquid crystal display element composed of a liquid crystal layer and having a plurality of pixels arranged in a matrix form; and a driver for dividing one frame into at least four fields and interlace-scanning the at least four fields, wherein the driver drives the respective fields composing one frame so that a scanning order of the fields is discontinued at least once.

According to the liquid crystal display apparatus having the above structure, since rewriting on a screen is driven by interlace scanning that writing scanning is executed while jumping over one or plural scanning lines, the display is completed for short time. At the same time, since the fields are driven so that their scanning order is discontinued at least once, the scanning lines in a black out state are prevented from becoming thick as much as possible, and the screen is clearly viewed.

In the liquid crystal display apparatus according to the first aspect of the present invention, it is preferable that the driver drives scanning lines by means of a driving waveform having a reset period for resetting a state of liquid crystals, a selection period for selecting a final display state of the liquid crystals, and a maintaining period for establishing the state selected at the selection period, namely, a phase transition driving system is adopted.

In addition, in the liquid crystal display apparatus according to the first aspect of the present invention, the respective fields are driven so that their scanning order is always discontinued or odd-numbered lines of the respective fields may be successively scanned and even-numbered lines are successively scanned.

In general, the scanning lines can be scanned according to the following equation:

$$S=a+nk$$

S: scanning lines to be driven on the respective fields in the plural continued scanning lines divided into plural groups according to a number of fields a: variable number, an initial value of which is one, and to which one is added each time when S exceeds the number of fields n: variable number, an initial value of which is zero, and to which one is added at every time of scanning on one field, and which returns to the initial value every time when S exceeds the number of fields k: integer of not less than 2.

For example, in the interlace scanning where one frame is divided into seven fields, when k is 3, the lines 1, 4, 7, 2, 5, 3 and 6 are successive scanned in this order. Moreover, in the interlace scanning where one frame is divided into four fields, when k is 2, the lines 1, 3, 2 and 4 are successively scanned in this order.

Further, in the liquid crystal display apparatus according to the first aspect of the present invention, the liquid crystal element is constituted so that a plurality of liquid crystal layers are laminated, and the respective liquid crystal layers maybe scanned by the driver. A plurality of liquid crystal layers are laminated so that display with full color can be carried out.

In addition, the scanning of the next field is started based on reset period end timing of one scanning line of the previous field so that the scanning lines in the display period always exist adjacently to the scanning line in the reset period. For this reason, a thick black line due to updating of the screen is difficultly generated.

The liquid crystals included in the liquid crystal display element have memory property, and more preferably the liquid crystals show a cholesteric phase at room temperature. The display element using such liquid crystals is small, light and thin, and has an advantage that even when supply of electric power is stopped after the display driving is ended, the display state can be maintained, and thus its power consumption is small. Moreover, due to high-speed driving, even if driving is carried out by the interlace scanning, the liquid crystals on the scanning lines where writing is not carried out is maintained in the display state. As a result, such liquid crystals are preferable in order to obtaining clear view.

A liquid crystal display apparatus according to a second aspect of the present invention comprises: a liquid crystal display element composed of a liquid crystal layer and having a plurality of pixels arranged in a matrix pattern; and a driver for dividing one frame into a plurality of fields and interlace-scanning the plurality of fields, wherein the driver drives scanning lines by means of a driving waveform having a reset period for resetting a state of liquid crystals, a selection period for selecting a final display state of the liquid crystals, and a maintaining period for establishing the state selected at the selection period, and starts scanning of next field based on reset period end timing of one scanning line of the previous field.

According to the invention of the second aspect of the present invention, since the scanning lines in the display period always exist adjacently to the scanning lines in the reset period, a thick black line due to updating of the screen is difficultly generated.

BRIEF DESCRIPTION OF THE DRAWINGS

These and other objects, advantages and features of the invention will become apparent from the following description thereof taken in conjunction with the accompanying drawings in which.

DESCRIPTION OF THE PREFERRED EMBODIMENTS

There will be explained below the liquid crystal display apparatus according to embodiments of the present invention with reference to the attached drawings.

Figure 1:
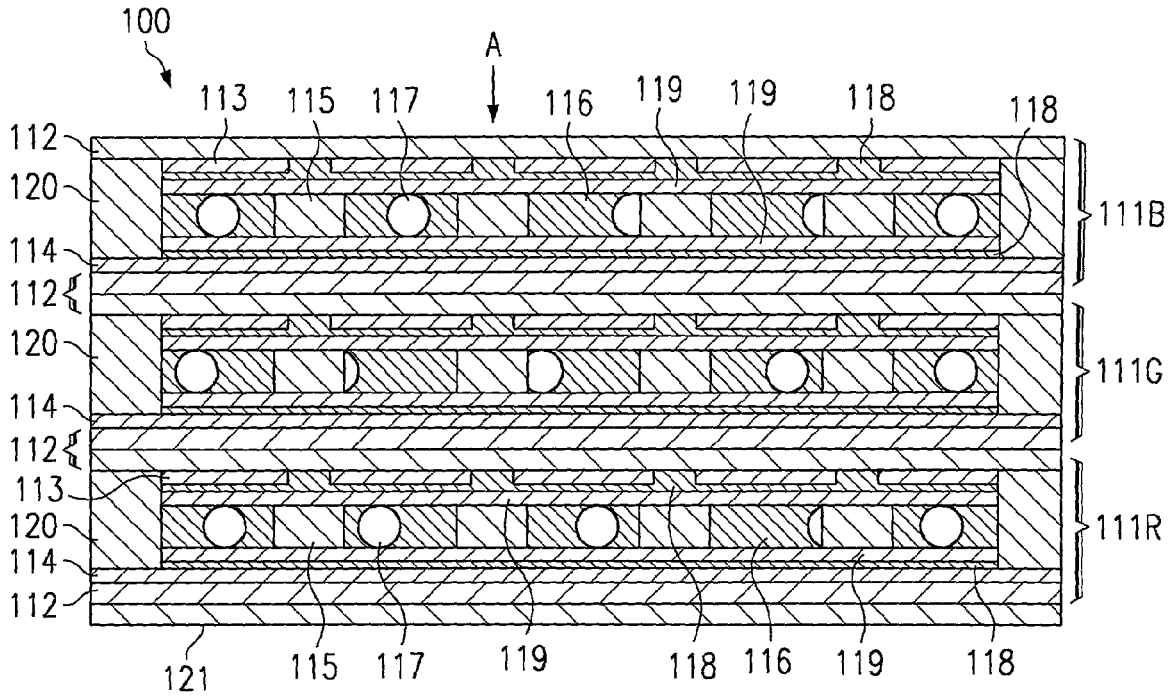
FIG. 1 is a cross sectional view showing one example of a liquid crystal display element to be used in a liquid crystal display apparatus according to the present invention.

(Liquid crystal display element: see FIG. 1)

At first, there will be explained below a liquid crystal display element having a liquid crystal layer showing cholesteric phase composing the liquid crystal display apparatus.

FIG. 1 shows a reflection type full-color liquid crystal display element using a simple matrix driving method. The liquid crystal display element 100 is constituted so that a red display layer 111R for displaying according to switching between red selective reflection and a transparent state is arranged on an optical absorption layer 121, a green display layer 111G for displaying according to switching between green selective reflection and the transparent state is laminated thereon, and further a blue display layer 111B for displaying according to switching between blue selective reflection and the transparent state is laminated thereon.

Each of the display layers 111R, 111G and 111B is constituted so that resin-made column structures 115, liquid crystal 116 and spacers 117 are sandwiched between transparent substrates 112 on which transparent electrodes 113 and 114 are formed. An insulating film 118 and an alignment regulating film 119 are provided on the transparent electrodes 113 and 114 as the need arises. Moreover, a sealing member 120 for sealing the liquid crystal 116 is provided on an outer peripheral section (other than display areas) of the substrate 112.

The transparent electrodes 113 and 114 are connected respectively to driving ICs 131 and 132 (see FIG. 2) A predetermined pulse voltages are respectively applied to the transparent electrodes 113 and 114. In response to the applied voltages, the liquid crystal 116 is switched between the transparent state that a visible light is transmitted through the liquid crystals 116 and a selective reflection state that a visible light with specified wavelength is selectively reflected thereby the displayed content is changed.

The transparent electrodes 113 and 114 provided on the display layers 111R, 111G and 111B are composed of a plurality of strip electrodes which are arranged parallel with fine intervals. The strip electrodes 113 and 114 are opposed to one another so that their arranging directions are in an right-angled direction. The upper and lower strip electrodes respectively act as scanning electrodes and signal electrodes, and the scanning electrodes are electrified successively so that a voltage is successively applied to the liquid crystal 116 in a matrix pattern to carry out display update. This is called as matrix driving, and portions where the electrodes 113 and 114 intersect one another compose respective pixels. Such matrix driving is carried out for each display layer so that a full-color image is displayed on the liquid crystal display element 100.

More specifically, in the liquid crystal display element where the liquid crystal showing cholesteric phase is sandwiched between the two substrates, display is carried out by switching the liquid crystal state between a planer state and a focal conic state. In the case where the liquid crystal is in the planer state, when a spiral pitch of the cholesteric liquid crystals is P and an average refractive index of the liquid crystals is n, a light with wavelength ($\lambda=P\cdot n$) is selectively reflected. On the other hand, in the focal conic state, when the selective reflection wavelength of the cholesteric liquid crystals is in an infrared light region, the light is scattered, and when the selective reflection wavelength is shorter, the visible light is transmitted. For this reason, the selective reflection wavelength is set in a visible light region and the optical absorption layer is provided on an opposite side of an observing side of the element so that display with a selective reflection color in the planer state and display with black in the focal conic state are possible. Moreover, when the selective reflection wavelength is set in the infrared light region and the optical absorption layer is provided on the opposite side of the observing side of the element, the light with wavelength in the infrared light region is reflected but the light with wavelength in the visible light region is transmitted in the planer state so that display with block is possible. In the focal conic state, display with white due to scattering is possible.

In the liquid crystal display element 100 where the display layers 111R, 111G and 111B are laminated, a red color display can be carried out by setting the blue display layer 111B and the green display layer 111G to the transparent state where the liquid crystals are in focal conic alignment, and by setting the red display layer 111R to the selective reflection state where the liquid crystals are in planer alignment. Moreover, a yellow display is carried out by setting the blue display layer 111B to the transparent state where the liquid crystals are in the focal conic alignment, and by setting the green display layer 111G and the red display layer 111R to the selective reflection state where the liquid crystals are in the planer alignment. Similarly, the state of the respective display layers is suitably selected from the transparent state and the selective reflection state so that display with red, green, blue, white, cyan, magenta, yellow and black can be carried out. Further, the intermediate selective reflection state where domains of the focal conic state and the planar state are simultaneously existed is selected as the state of the respective display layers 111R, 111G and 111B, display with neutral color can be carried out. As a result, the liquid crystal display element 100 can be utilized as a full-color display element.

As the liquid crystal 116, liquid crystal showing cholesteric phase at room temperature is preferable, and particularly, chiral nematic liquid crystal which is obtained by adding a chiral material to nematic liquid crystal is suitable.

The chiral material is an additive having a function for twisting molecules of the nematic liquid crystal in the case where the chiral material is added to the nematic liquid crystal. When the chiral material is added to the nematic liquid crystal, a spiral structure of the liquid crystal molecules having predetermined twisting intervals is generated. As a result, the cholesteric phase appears.

Here, the memory property liquid crystal itself is not necessarily limited to this structure, and the liquid crystal display layer can be structured as a so-called polymer dispersion type liquid crystal composite film in which liquid crystal is dispersed in a polymer three-dimensional mesh structure which is conventionally well known, or the polymer three-dimensional mesh structure is formed in the liquid crystal.

Figure 2:
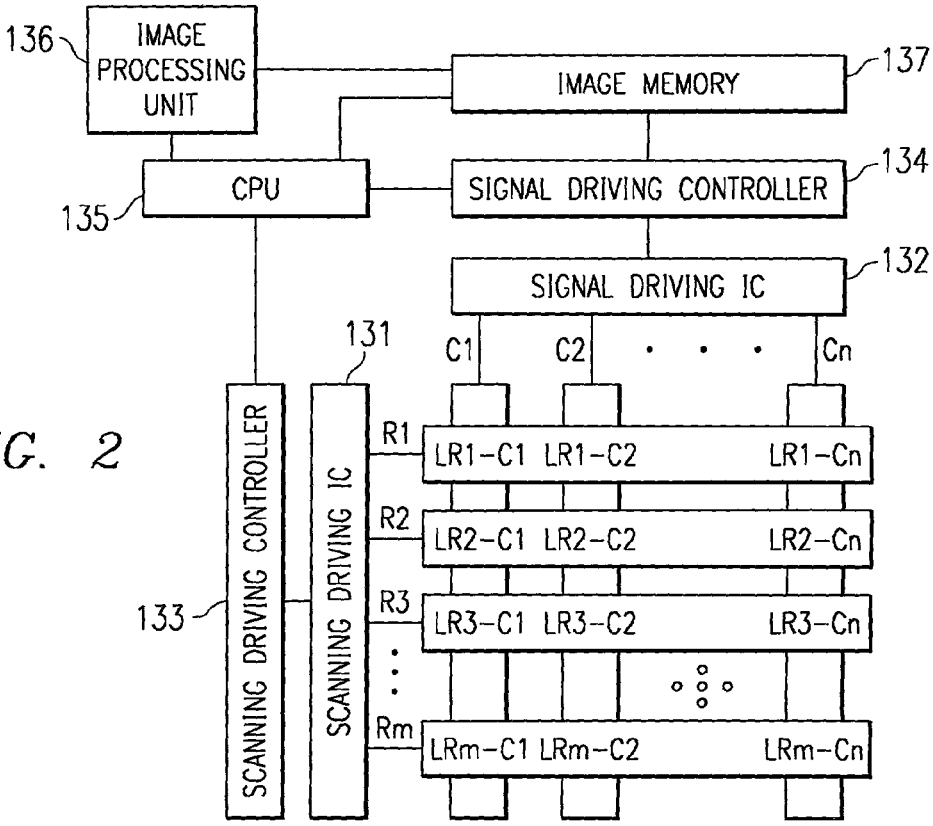
FIG. 2 is a block diagram showing a driving circuit of the liquid crystal display element.

(Driving circuit: see FIG. 2)

As shown in FIG. 2, the pixel structure of the liquid crystal display element 100 is represented by matrices composed of a plurality of scanning electrodes R1, R2 through Rm and signal electrodes C1, C2 through Cn (m and n are natural numbers). The scanning electrodes R1, R2 through Rm are connected with output terminals of the scanning driving IC 131. The signal electrodes C1, C2 through Cn are connected with output terminals of the signal driving IC 132.

For simplification of the explanation, FIG. 2 shows only one-system driving circuit for driving one liquid crystal layer, but actually three-system driving circuits for driving the three liquid crystal layers are provided, and a driving method, mentioned later, is executed for the respective liquid crystal layers. The scanning electrodes are and the signal electrodes may be commonly used for the respective liquid crystal layers. For example, the scanning electrodes are commonly used for the respective liquid crystal layers, and the scanning driving IC of the respective liquid crystal layers may be commonly used.

The scanning driving IC 131 outputs a selection signal to selected one of scanning electrodes R1, R2 through Rm that is specified so that the specified electrodes are in a selected state. Meanwhile, the scanning driving IC 131 outputs a non-selection signal to each of the remaining scanning electrodes so that they are in an unselected state. The scanning driving IC 131 switches the electrodes with predetermined time intervals so as to apply the selection signal to the scanning electrodes R1, R2 through Rm successively. Meanwhile, the signal driving IC 132 outputs signals according to image data to the signal electrodes C1, C2 through Cn simultaneously so as to rewrite the respective pixels on the scanning electrodes R1, R2 through Rm in the selected state. For example, when the scanning electrode Ra is selected (a is a natural number which satisfies a≦m), pixels LRa—C1 through LRa—Cn on cross sections of the scanning electrode Ra and the signal electrodes C1, C2 through Cn are rewritten simultaneously. As a result, a voltage difference between the scanning electrodes and the signal electrodes on the respective pixels becomes a rewriting voltage, and the pixels are rewritten according to the rewriting voltage.

The driving circuit is composed of a central processing unit 135, an image processing unit 136, an image memory 137, controllers 133 and 134, and driving ICs (drivers) 131 and 132. The controllers 133 and 134 control the driving ICs 131 and 132 based on image data stored in the image memory 137. A voltage is successively applied between the respective scanning electrodes and the signal electrodes of the liquid crystal display element 100, and the image is written into the liquid crystal element 100.

Here, in the case where a first threshold voltage for solving the twisting of the liquid crystals showing the cholesteric phase is $V_{th1}$, when the voltage is lowered to not more than a second threshold voltage $V_{th2}$ lower than the first threshold voltage $V_{th1}$ after the voltage $V_{th1}$ is applied for sufficient time, the liquid crystals are in the planer state. Moreover, when a voltage which is not less than $V_{th2}$ and not more than $V_{th1}$ is applied for sufficient time, the liquid crystals are in the focal conic state. These two states are maintained stably even after the applying of the voltage is stopped. Further, a voltage in the range of $V_{th1}$ to $V_{th2}$ is applied so that display with half tone, namely, contrast display can be carried out.

In the case where partial rewriting is carried out, only specified scanning lines may be successively selected so as to include a portion to be rewritten. As a result, only necessary portion can be rewritten for short time.

Figure 3:
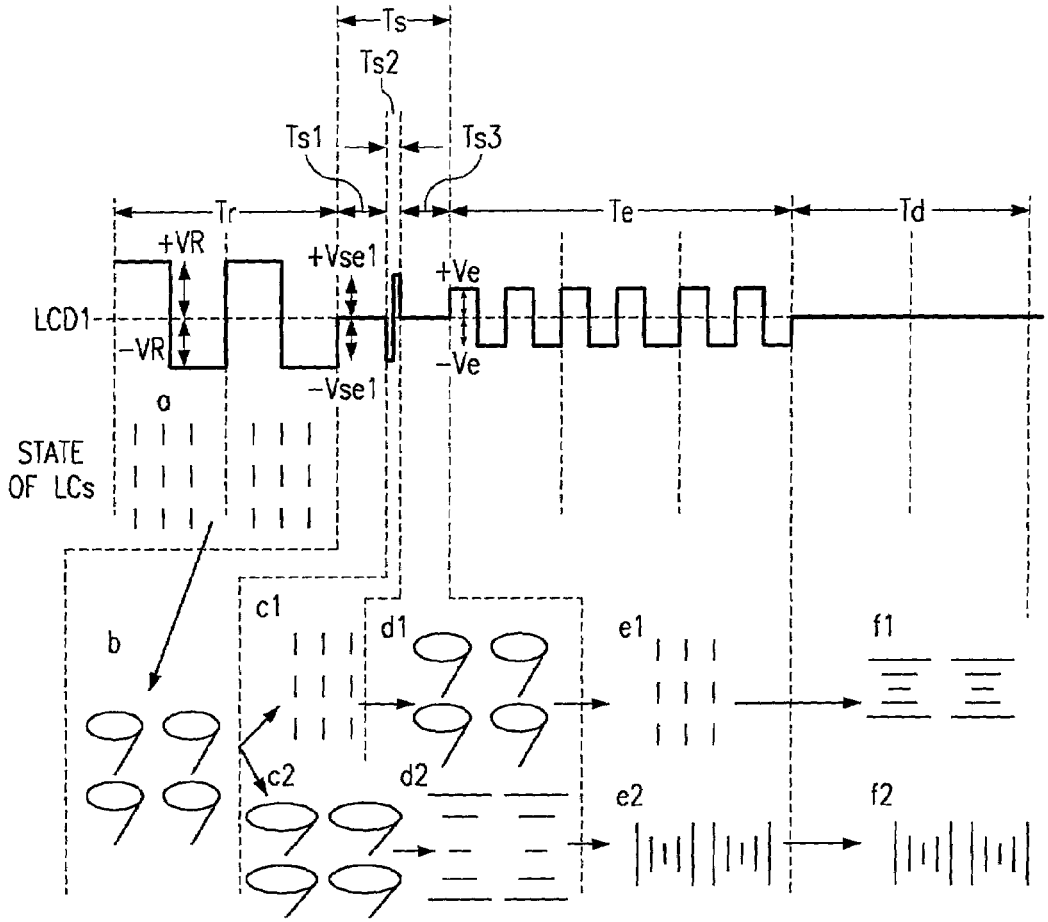
FIG. 3 is an explanatory diagram showing a principle of a driving method 1 of the liquid crystal display element.
Figure 4:
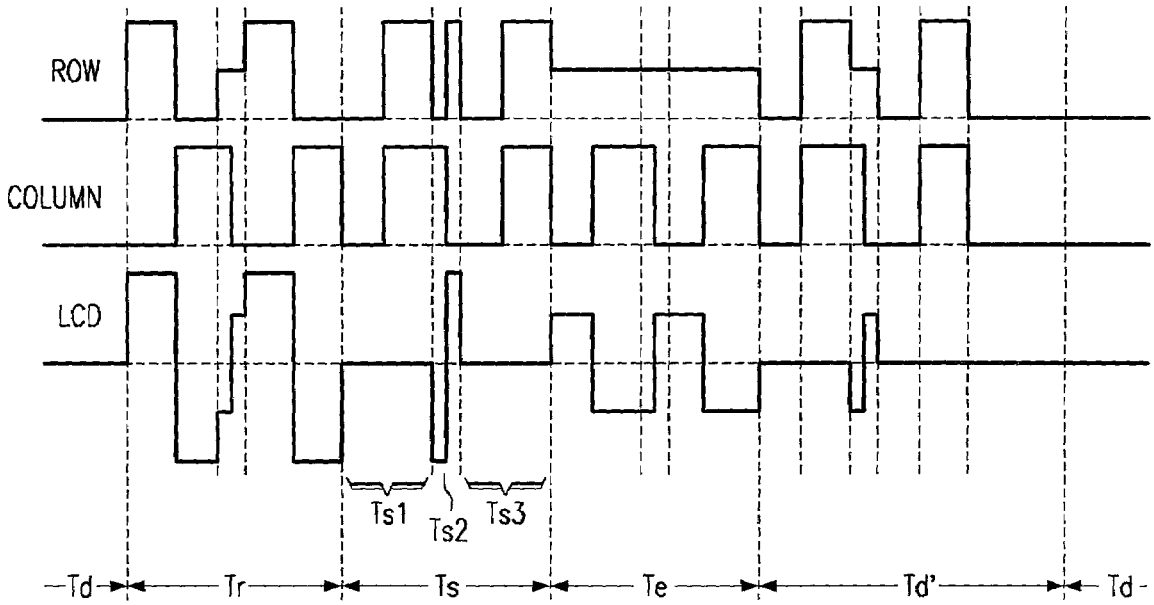
FIG. 4 is a chart showing basic driving waveforms in the driving method 1.

(Driving method 1, Driving principle: see FIGS. 3 and 4)

There will be explained below one example of the driving method which is applicable to the liquid crystal display element 100. At first, the explanation will be given as to the driving principle of the driving method. Here, concrete example using an alternated pulse waveform will be explained, but needless to say the driving method is not limited to this waveform. The driving method to be explained as one example is composed of, as shown in FIG. 3, mainly a rest period $T_r$, a selection period $T_s$, a maintaining period $T_e$ and a display period $T_d$.

In FIG. 3, the upper stage shows a driving waveform which is applied to liquid crystal (LCD1) of a certain pixel, and the lower stage schematically shows a state of the liquid crystals at the respective periods. As shown in FIG. 3, in this example, the reset period $T_r$ is set to be twice as long as the selection period $T_s$, and the maintaining period $T_e$ is set to be three times as long as the selection period $T_s$. Therefore, the rewriting for one line is completed for the period which is six times as long as the selection period $T_s$, and in the case where the liquid crystals are linearly driven successively, it is viewed that strap dark portions for 6 lines run.

At first, a voltage with an absolute value $V_R$ is applied to the pixels on the scanning electrodes where writing is carried out at the reset period $T_r$ so that the pixels on the scanning electrodes are reset into a homeotropic state (see "a" in FIG. 3).

The selection period $T_s$ is further composed of three periods (pre-selection period $T_{s1}$, selection pulse applying period $T_{s2}$ and post-selection period $T_{s3}$). At the pre-selection period $T_{s1}$ the voltage which acts upon the pixels on the scanning electrodes where writing is carried out is set to zero. At this time, it is considered that the liquid crystals are brought into a state that their twisting is slightly released (first transition state) (see "b" in FIG. 3). Next, a selection pulse is applied according to an image to be displayed (selection pulse applying period $T_{s2}$) At the selection pulse applying period $T_{s2}$ forms of the pulses to be applied are different between the pixels on which the planer state is desired to be selected and the pixels on which the focal conic state is desired to be selected. Therefore, as for the states after the selection pulse applying period $T_{s2}$, the case where the planer state is selected and the case where the focal conic state is selected will be explained separately.

In the case where the planer state is selected, a selection pulse with absolute value $V_{se1}$ is applied at the selection pulse applying period $T_{s2}$ so that the liquid crystals are again brought into the homeotropic state (see "c1" in FIG. 3). Thereafter, when the voltage is set to zero at the post-selection period $T_{s3}$, the twisting of the liquid crystals is slightly released (see "d1" in FIG. 3). It is considered that this state is approximately equal with the first transition state.

At the following maintaining period $T_e$, a pulse voltage with absolute value $V_e$ is applied to the pixels on the scanning electrodes where writing is carried out. As for the liquid crystals where their twisting is slightly released at the previous selection period $T_s$, the twisting is again released by the application of the pulse voltage $V_e$ so that the liquid crystals are in the homeotropic state (see "e1" in FIG. 3).

At display period $T_d$ the voltage to be applied to the liquid crystals is set to zero. The liquid crystals in the homeotropic state are brought into the planer state by setting the voltage to zero (see "f1" in FIG. 3). In such a manner, the planer state is selected.

Meanwhile, in the case where the focal conic state is finally desired to be selected, at selection pulse applying period $T_{S2}$ the voltage to be applied to the liquid crystals are set to zero. As a result, the twisting of the liquid crystals is further released (second transition state) (see "c2" in FIG. 3). Similarly to the case where the planer state is selected, the voltage to be applied to the liquid crystals is set to zero at post-selection period $T_{s3}$. As a result, the twisting of the liquid crystals is released so that the liquid crystals are brought into a state that their helical pitches are widened to be approximately doubled (third transition state) (see "d2" in FIG. 3). Here, it is considered that this state is close to a state which is called as transient planer described in the specification of U.S. Pat. No. 5,748,277.

Similarly to the case where the planer state is selected, at the following maintaining period $T_e$, a pulse voltage with absolute value $V_e$ is applied to the pixels on the scanning lines where writing is carried out. The liquid crystals where the twisting is released at the previous selection period $T_s$ are changed into the focal conic state by applying the pulse voltage $V_e$ (fourth transition state, see "e2" in FIG. 3).

Similarly to the case where the planer state is selected, at display period $T_d$ the voltage to be applied to the liquid crystals is set to zero. Even when the voltage is set to zero, the liquid crystals in the focal conic state are fixed in this state. In such a manner, the focal conic state is selected (see "f2" in FIG. 3).

As mentioned above, according to the selection pulse to be applied for short time at the center of the selection period $T_s$, namely, selection pulse applying period $T_{s2}$, the final display state of the liquid crystals can be selected. Moreover, when a pulse width of the selection pulse is adjusted, more concretely, the form of the pulse to be applied to the signal electrodes is changed according to image data, display with half tone can be carried out.

The values of the voltages to be applied to the liquid crystals at the pre-selection period $T_{s1}$, and post-selection period $T_{s3}$ may be approximately zero and in a range of the voltage value at which a voltage does not practically function.

FIG. 4 shows one example of a driving voltage waveform to be applied to the liquid crystals of a certain pixel in the plural pixels arranged in the matrix form and waveforms of the scanning electrodes (row) and the signal electrodes (column) for obtaining the driving voltage waveform. In FIG. 4, the "row" means one line on the scanning electrodes, and the "column" means one line on the signal electrodes. Moreover, LCD means a liquid crystal layer for one pixel of a cross section of the row and the column.

As shown in FIG. 4, in the case of the matrix driving, since data are written into the pixels on the other scanning electrodes after maintaining period $T_e$ passes, predetermined voltages are applied as cross talk voltages from the signal electrodes. A period at which the cross talk voltages is applied is called as cross talk period $T_{d'}$. Since the cross talk voltages have a small pulse width and its energy is weak, it hardly influences the state of the liquid crystals.

When all of the selection of the scanning electrodes are completed and the maintaining period $T_e$ of the finally selected scanning electrode is ended, the cross talk period $T_d$ of the other scanning electrodes is completely ended, and the applied voltages to all the scanning electrodes and signal electrodes become zero so that display period $T_d$ comes. This state is continued until next rewriting.

In FIG. 4, for simplification, all the lengths of the reset period $T_r$, the selection period $T_s$, the maintaining period $T_e$ and the cross talk period $T_{d'}$ are equal to one another. Moreover, for the same reason, in FIG. 4, all the signals of the columns are drawn as pulses for selecting the planer state.

(Driving method)

There will be explained below a concrete example of the matrix driving method. In the following concrete example, the rows 1 through 3 mean three scanning electrodes to be successive selected, and the column means one signal electrode which crosses the respective scanning electrodes, and LCDs 1 through 3 mean the liquid crystal layer corresponding to the three pixels formed on the cross sections of the rows 1 through 3 and the column.

Figure 5:
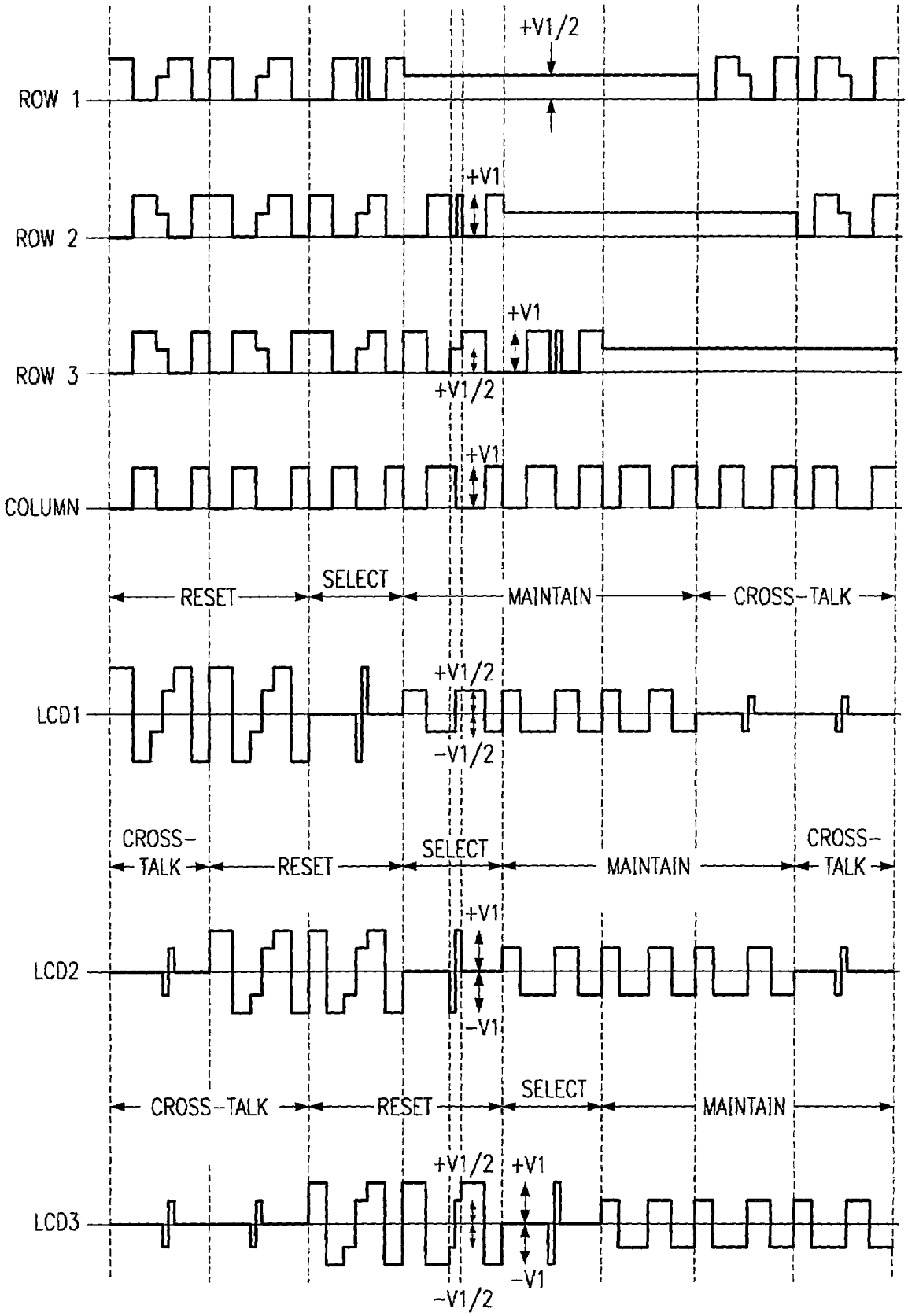
FIG. 5 is a chart showing driving waveforms according to a driving example 1.

(Matrix driving example 1: see FIG. 5)

As mentioned before, in the driving method of the present embodiment, the reset period, the selection period, the maintaining period and the cross talk period are provided. Further, the selection period is divided into three periods: pre-selection period, selection pulse applying period and post-selection period. The selection pulse is applied only at one of the selection periods.

It is necessary to change the form of the selection pulse according to image data to be displayed on the pixels where writing is carried out, and selection pulses having different forms should be applied to the column according to the image data. Meanwhile, since the zero voltage is always applied to the liquid crystals in the pixels at pre-selection period and post-selection period, combinations of predetermined pulse waveforms can be used for the rows and column so that the zero voltage can be obtained. In the driving example 1 shown in FIG. 5, this is utilized so that reset, maintaining and display are carried out simultaneously for the pixels on the plural scanning electrodes.

For example, when LCD 2 is in the pre-selection period, pulse voltages $+V_1$ with different phases are applied to the rows 2 and 3 respectively, and a voltage of $+V_1/2$ is applied to the row 1. At this time, when the pulse voltage $+V_1$ with different phase from that of the row 3 is applied to the column, a reset pulse of voltage $\pm V_R=\pm V_1$ is applied to LCD 3, a zero voltage is applied to LCD 2, and a maintaining pulse of voltage $\pm V_e=\pm V_1/2$ is applied to LCD 1.

When LCD 2 is in the selection pulse applying period, since data pulses (voltage$+V_1$) having different forms according to image data are applied from the column, a pulse of voltage $+V_1/2$ is applied to the rows 1 and 3, and a voltage of $\pm V_1/2$ is applied to the LCD 1 and LCD 3. A pulse of voltage $+V_1$ is applied to the row 2, and a voltage difference ($\pm V_1$ or zero) between the pulse of voltage $+V_1$ and a data pulse to be applied to the column is applied as a selection pulse of voltage $\pm V_{se1}$ to the LCD 2. The form of the data pulse to be applied to the column is changed so that the pulse width of the selection pulse can be changed.

At post-selection period, the same process as the pre-selection period is executed. Namely, the pulse voltages $+V_1$ with different phases are applied to the rows 2 and 3, and the voltage of$+V_1/2$ is applied to the row 1. When the pulse voltage $+V_1$ having different phase from that of the row 3 is applied to the column, the reset pulse of voltage $\pm V_R=\pm V_1$ is applied to the LCD 3, the zero voltage is applied to the LCD 2, and the maintaining pulse of voltage $\pm V_e=\pm V_1/2$ is applied to the LCD At periods other than the reset period, the selection period and the maintaining period, a waveform having the same phase as that of the data pulse applied from the signal electrode at the pre-selection period and the post-selection period of the other scanning electrodes is applied to the respective scanning electrodes, and the pulse of the voltage $+V_1/2$ is applied to the other scanning electrodes at the selection pulse applying period of the other scanning electrodes. As a result, the cross talk voltage of $\pm V_1/2$ is applied to the liquid crystals on this portion according to the image data at the same pulse width as the selection pulse. Since the cross talk voltage has narrow pulse width, it does not influence the display state of the liquid crystals.

The above-mentioned application of the pulse voltages is repeated for the respective scanning electrodes so that an image can be displayed. The respective scanning electrodes are selected by interlace scanning as mentioned later. Since the reset pulse, the selection pulse and the maintaining pulse can be applied to arbitrary scanning electrodes, partial rewriting can be carried out.

In the example 1, an output voltage number necessary for the driving IC becomes ternary ($V_1$, $V_1/2$ and GND) on the row side and binary ($V_1$ and GND) on the column side. In such a manner, a driver with ternary on the row side and binary on the column side is used so that the cost of the driving IC can be reduced.

Figure 6:
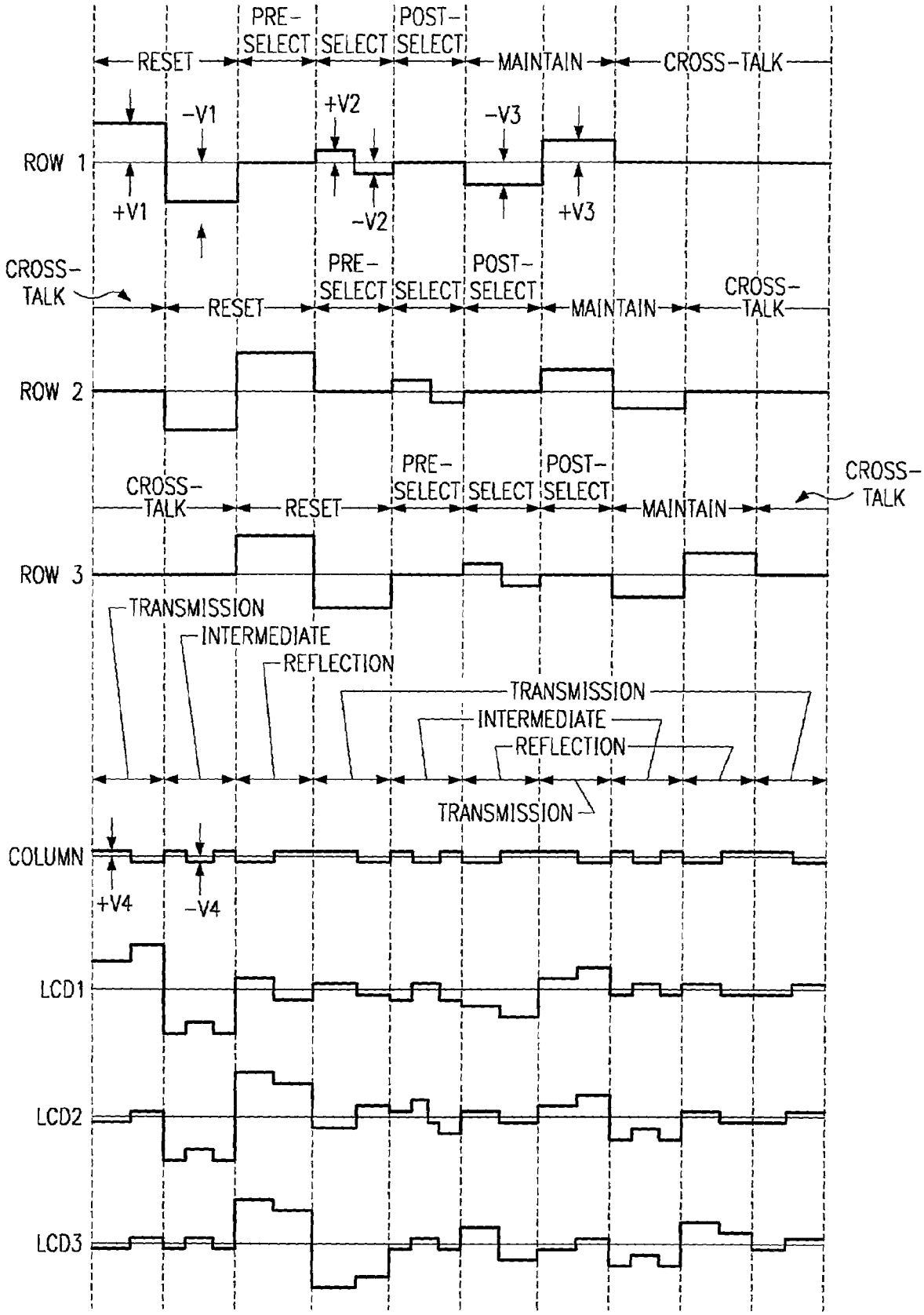
FIG. 6 is a chart showing driving waveforms according to a driving example 2.

(Matrix driving example 2: see FIG. 6)

In the driving example 1, the scanning is carried out based on the length of the whole selection period. On the contrary, in the driving example 2, the scanning is carried out based on the selection pulse applying period. More concretely, the pulse width of the selection pulse is modulated, and the scanning is carried out based on a maximum pulse width which brings the liquid crystals into the state that the liquid crystals show the highest reflectance. Here, signal voltages for selecting transmission, half tone and total reflection in this order are input to the signal electrodes.

In the driving example 2, as mentioned before, the selection period is divided into the selection pulse applying time, the pre-selection time and the post-selection time before and after the selection pulse applying time. The lengths of the pre-selection time and the post-selection time are set to be integral multiples of the selection pulse width (selection pulse applying time) (in FIG. 6, one time).

In this case, a reset voltage $\pm V_1$, a selection voltage $\pm V_2$ and a maintaining voltage $\pm V_3$ are applied to the respective scanning electrodes (rows 1, 2 and 3), and the lengths of the reset period and the maintaining period are set to be integral multiples of the selection pulse applying time (in FIG. 6, twice). Moreover, the voltage is 0 V at the display (cross talk) period. Meanwhile, a pulse waveform of voltage $\pm V_4$ where the phase is shifted according to image data is applied to the signal electrode (column)

In the driving example 2, the waveform of the selection pulse is determined based on the phase and voltage value of the applied voltage $\pm V_4$ to the column, and the selection voltage $\pm V_2$. When the phase of the voltage $\pm V_4$ is the same as the selection voltage $\pm V_2$, the selection pulse becomes $\pm(V_2-V_4)$ so that transmission (focal conic state) is selected. When the phase of the voltage $\pm V_4$ is opposite to the selection voltage $\pm V_2$, the selection pulse becomes $\pm(V_2+V_4)$, and selective reflection (planer state) is selected. Here, the values of the voltages $V_2$ and $V_4$ are values which are suitable for selecting transmission and reflection, and the value of the voltage $V_4$ to be a cross talk is a value which is within a predetermined threshold value for changing the state of the liquid crystals.

In the driving example 2, the scanning is carried out with it being shifted by the selection pulse applying time (namely, the selection pulse applying time is equal with the scanning time) However, in the case where pre-selection time and post-selection time are provided, the scanning may be carried out with it being shifted by the selection period including the pre-selection time and the post-selection time (namely, the selection period is equal with the scanning time).

(Interlace scanning)

There will be explained below the driving method according to interlace scanning by exemplifying the scanning examples 1 through 5. The interlace scanning is counterposed to the linear successive scanning. The interlace scanning is a form that one frame (one image) is divided into a plurality of fields and the scanning is carried out while jumping over one or plural scanning lines.

Figure 7:
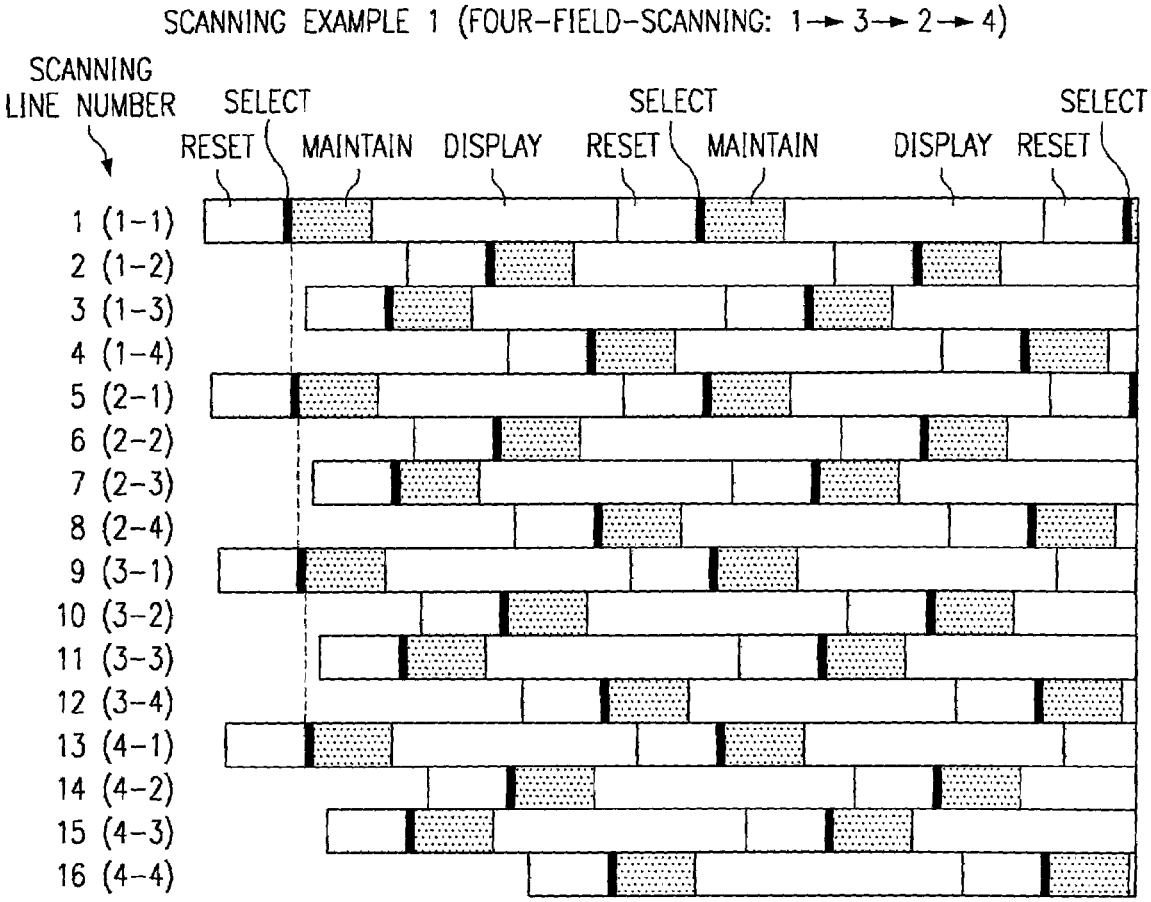
FIG. 7 is a chart showing an interlace scanning example

(Scanning example 1: see FIG. 7)

In the scanning example 1, one frame is divided into four fields, and writing is carried out successively on the respective scanning lines of the first field (namely, when the scanning line is divided into a plurality of groups according to a number of the fields, the head scanning lines in the respective groups). Writing is successively carried out on the respective scanning lines of the third field (namely, the third scanning lines of the respective groups), the second field (namely, the second scanning lines of the respective groups) and the fourth field (namely, the fourth scanning lines of the respective groups). As a result, an image of one frame is displayed. As shown in FIGS. 3 and 4, the writing on the respective scanning lines is composed of reset period $T_r$, selection period $T_s$ and maintaining period $T_e$, and the liquid crystal display element is in the black out state that the optical absorption layer on the rear surface is viewed at these three periods (see FIG. 8). Thereafter, the liquid crystals are maintained in the display state $T_d$.

In the scanning example 1, the scanning of one frame is discontinued twice when the scanning proceeds from the first field to the third field and from the second field to the fourth field. Therefore, in comparison with the successive scanning on the first field, the second field, the third field and the fourth field, the scanning lines to be scanned are dispersed in a signal line direction. Therefore, a thick black line is hardly generated.

In addition, since next field is started to be scanned based on reset period end timing of the finals canning line of the previous field, display period which is adjacent to reset period is always generated. As a result, a thick black line is hardly generated.

Particularly, in the scanning example 1, at most periods, a number of scanning lines at display period is two, and a number of scanning lines in the black out state is two (one is at reset period and the other is at maintaining period) in one divided unit. Therefore, on the display of one frame, a change in brightness on the screen is small.

Figure 8:
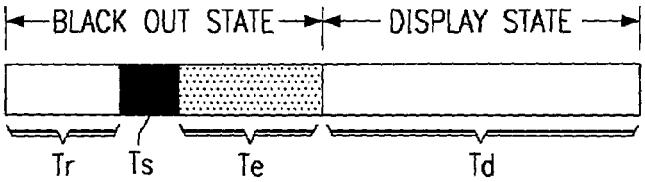
FIG. 8 is a chart showing a period for writing to 1 pixel.

Here, in the case of the matrix driving, since cross talk is generated on the pixels on non-selection lines due to a pulse of the selection lines, cross talk is actually generated during rewriting on the screen at the display period in FIG. 8, and the liquid crystals are at cross talk period $T_{d'}$.

In addition, since display does not possibly appear just after the maintaining period is ended depending on the types of the liquid crystals, in this case delay period from the end of the maintaining period to appearance of the display is previously measured. As a result, when the driving is actually carried out, the delay time may be taken into consideration. This point is similarly applied to the following scanning examples.

Figure 9:
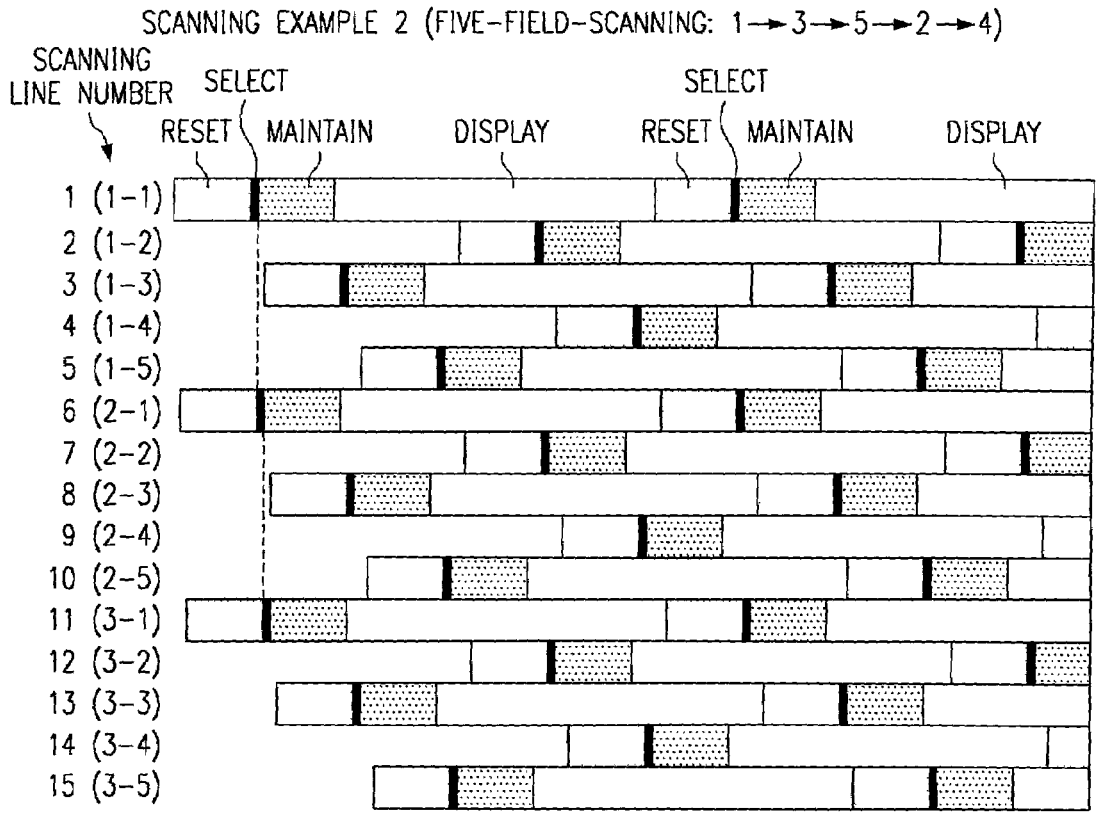
FIG. 9 is a chart showing an interlace scanning example 2.

(Scanning example 2: see FIG. 9)

In the scanning example 2, one frame is divided into five fields. At first, writing is successively carried out on the scanning lines of the first field, and writing is carried out on the scanning lines of the third field, the fifth field, the second field and the fourth field in this order. As a result, an image of one frame is displayed.

In the scanning example 2, in addition to the effect of the scanning example 1, since scanning lines in the black out state are not adjacent to one another, a thick black line is not generated.

Figure 10:
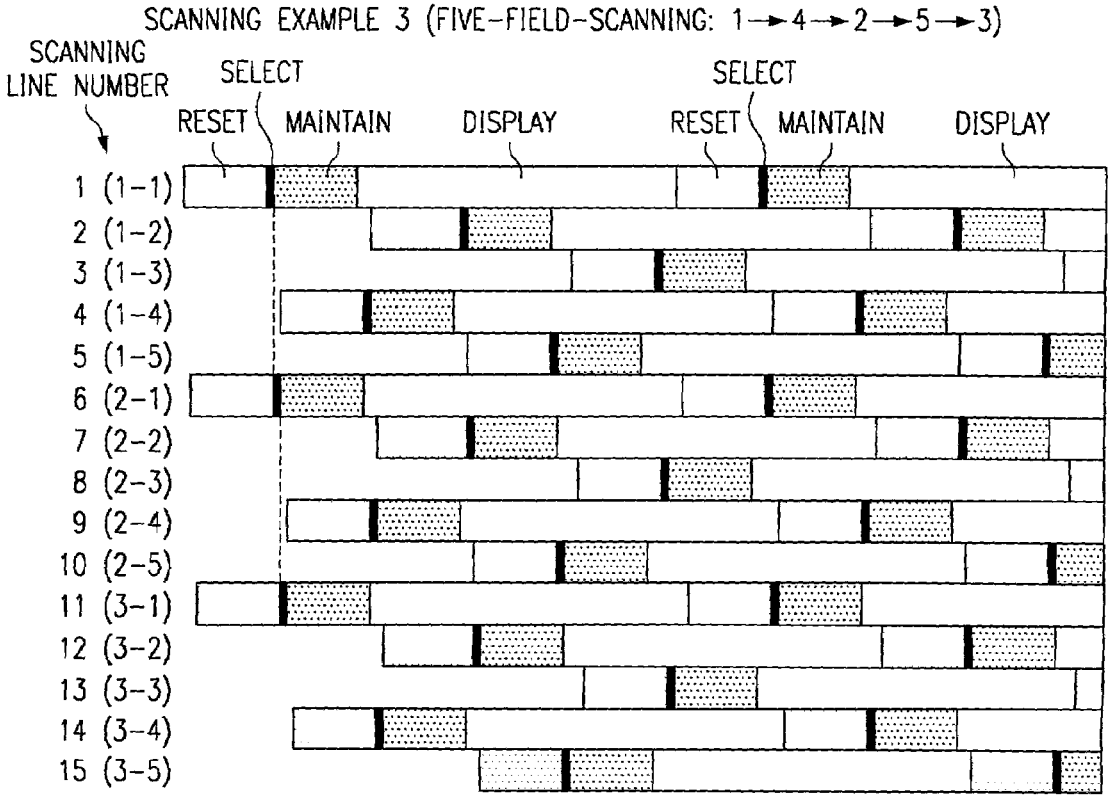
FIG. 10 is a chart showing an interlace scanning example 3.

(Scanning example 3: see FIG. 10)

In the scanning example 3, one frame is divided into five fields. At first writing is carried outs on the scanning lines of the first field, and writing is carried out successively on the scanning lines of the fourth field, the second field, the fifth field and the third field in this order. As a result, an image of one frame is displayed.

Similarly to the scanning example 2, in the scanning example 3, since scanning lines in the black out state are not adjacent to one another at all, a thick black line is not generated.

Figure 11:
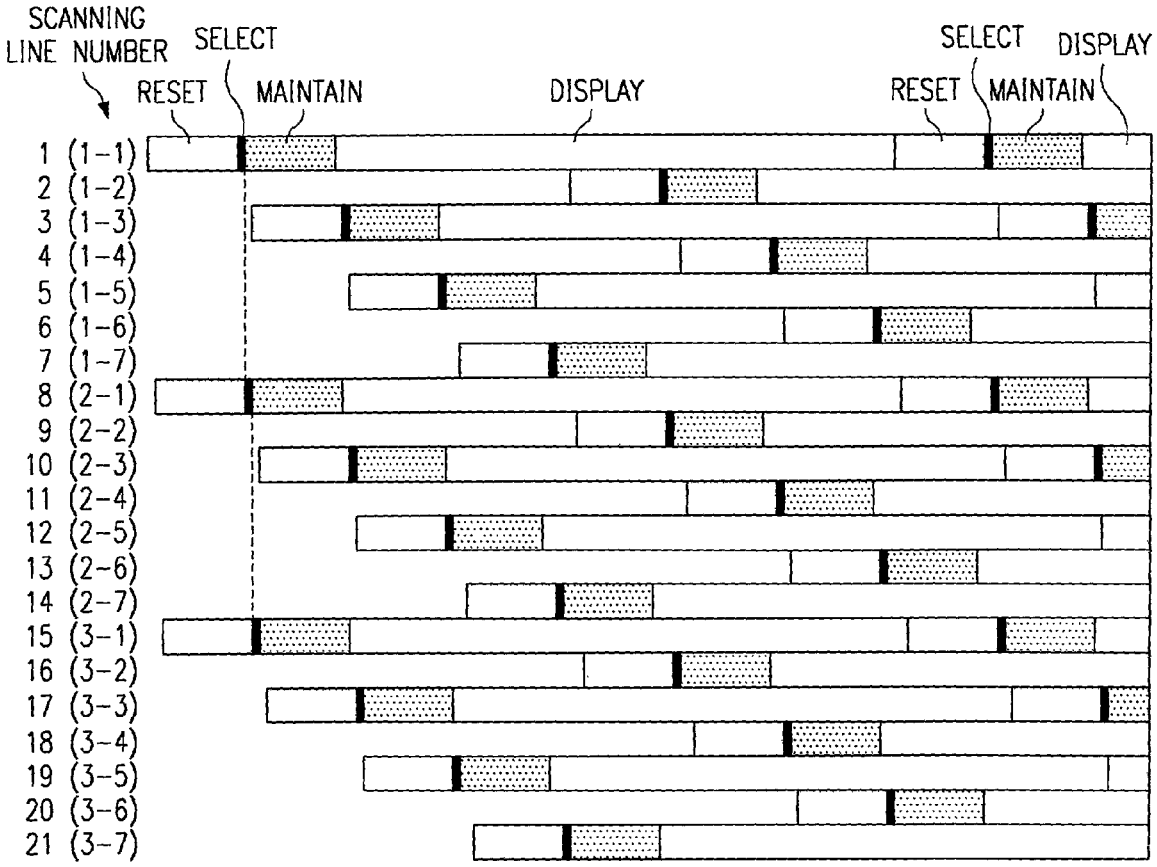
FIG. 11 is a chart showing an interlace scanning example 4.

(Scanning example 4: see FIG. 11)

In the scanning example 4, one frame is divided into seven fields. At first writing is carried out on the scanning lines of the first field, and writing is carried out successively on the scanning lines of the third field, the fifth field, the seventh field, the second field, the fourth field and the sixth field in this order. As a result, an image for one frame is displayed.

Similarly to the scanning examples 2 and 3, in the scanning example 4, since scanning lines in the black out state are not adjacent to one another at all, a thick black line is not generated.

Figure 12:
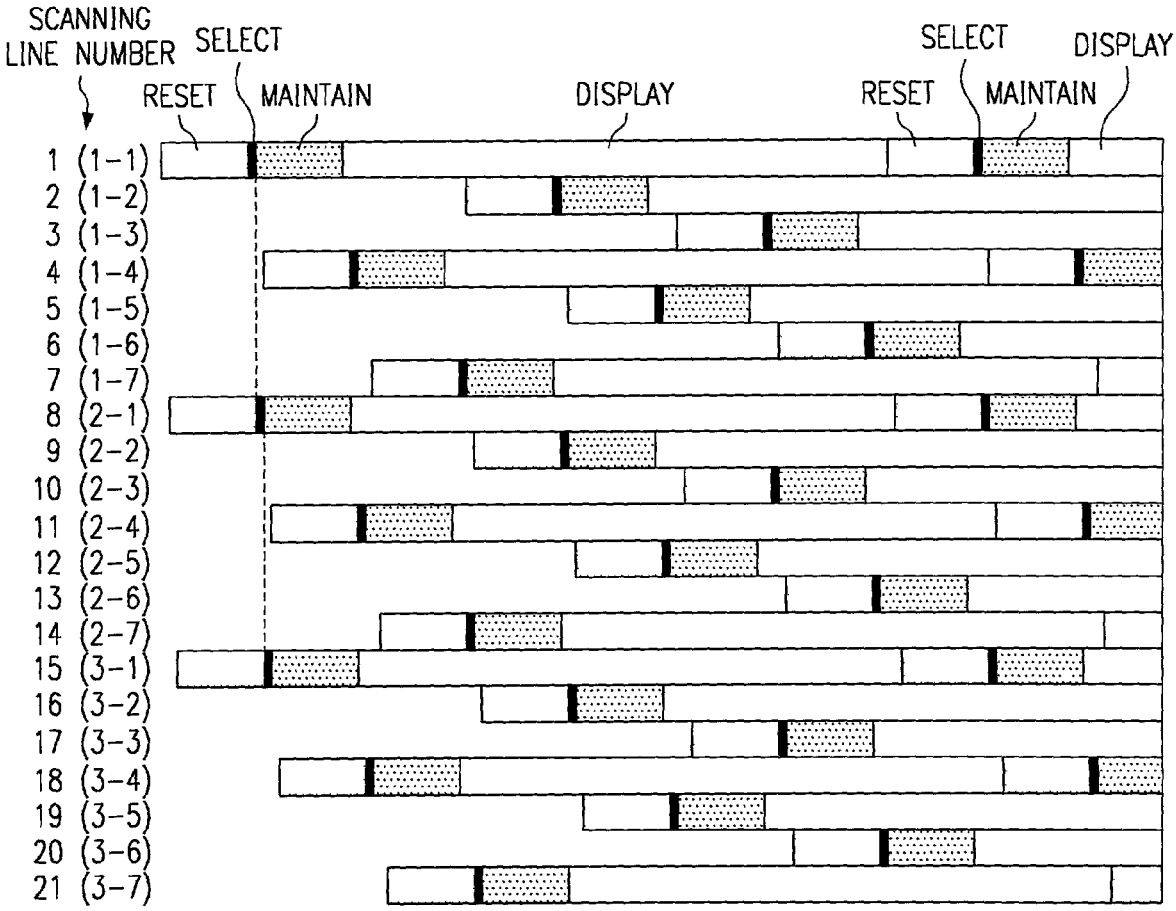
FIG. 12 is a chart showing an interlace scanning example 5.

(Scanning example 5: see FIG. 12)

In the scanning example 5, one frame is divided into seven fields. At first writing is carried out on the scanning lines of the first field, and writing is carried out successively on the scanning lines of the fourth field, the seventh field, the second field, the fifth field, the third field and the sixth field in this order. As a result, an image of one frame is displayed.

Similarly to the scanning example 4, in the scanning example 5, since scanning lines in the black out state are not adjacent one another at all, a thick black line is not generated.

(General explanation of scanning order)

The scanning examples 1 through 5 are given as concrete scanning examples, but the interlace scanning in the liquid crystal display apparatus of the present invention can be carried out on the scanning lines according to the following equation.

$$S=a+nk$$

where S is scanning lines to be driven on the respective fields in the plural continued scanning lines divided into plural groups according to a number of fields;

a is variable number, an initial value of which is one, and to which one is added each time when S exceeds the number of fields;

n is variable number, an initial value of which is zero, and to which one is added at every time of scanning on one field, and which returns to the initial value every time when S exceeds the number of fields; and k: integer of not less than 2.

The scanning example 1 shown in FIG. 7 is the case where a number of field divisions is 4 and k is 2. The scanning example 2 shown in FIG. 9 is the case where a number of field divisions is 5 and k is 2. The scanning example 3 shown in FIG. 10 is the case where a number of field divisions is 5 and k is 3. The scanning example 4 shown in FIG. 11 is the case where a number of field divisions is 7 and k is 2. The scanning example 5 shown in FIG. 12 is the case where a number of field divisions is 7 and k is 3.

(Another embodiment)

The liquid crystal display apparatus of the present invention is not limited to the above embodiments, and the invention can be changed variously in the scope of the gist of the invention.

Particularly the structure, material and manufacturing method of the liquid crystal display element, the configuration of the driving circuit and the like are arbitrary. Moreover, various forms which are not explained in the aforementioned embodiments can be adopted as the driving methods and the scanning example.

Further, a number of the scanning lines, a number of the signal lines and a number of field divisions in the aforementioned embodiments are one example. The present invention is not limited to them, and these numbers can be changed variously.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A liquid crystal display apparatus comprising:

a liquid crystal display element composed of a liquid crystal layer and having a plurality of pixels arranged in a matrix form, said liquid crystal layer including liquid crystal material having a memory property and exhibiting a cholesteric phase at room temperature; and a driver for dividing one frame into at least four fields and interlace-scanning the at least four fields, wherein said driver drives the respective fields composing one frame so that a scanning order of the fields is non-sequential at least once, and wherein said driver drives scanning lines by means of a driving waveform having a reset period for resetting a state of liquid crystal material, a selection period for selecting a final display state of the liquid crystal material, and a maintaining period for establishing the state selected during the selection period, so as to suppress generation of a stripe pattern due to black out.

2. The liquid crystal display apparatus claimed in claim 1, wherein said driver drives the respective fields so that scanning order thereof is always non-sequential.

3. The liquid crystal display apparatus claimed in claim 1, wherein said driver successively scans odd-numbered lines of the respective fields and successively scans even-numbered lines.

4. The liquid crystal display apparatus claimed in claim 1, wherein said liquid crystal display element is constituted so that a plurality of liquid crystal layers are laminated, and the liquid crystal layers are scanned by said driver.

5. The liquid crystal display apparatus claimed in claim 1, wherein the scanning of next field is started based on reset period end timing of one scanning line of the previous field.

6. The liquid crystal display apparatus claimed in claim 1 further comprising:

an optical absorption layer arranged behind said liquid crystal layer, wherein said liquid crystal layer exhibits a transparent state unless the maintaining period terminates.

7. The liquid crystal display apparatus claimed in claim 1, wherein said driver applies a voltage having an absolute value greater than 0 volts on said liquid crystal layer during said maintaining period.

8. A liquid crystal display apparatus comprising:

a liquid crystal display element composed of a liquid crystal layer and having a plurality of pixels arranged in a matrix form, said liquid crystal layer including liquid crystal material having a memory property and exhibiting a cholesteric phase at room temperature; and a driver for dividing one frame into at least four fields and interlace-scanning the at least four fields, wherein said driver drives the respective fields composing one frame so that a scanning order of the fields is non-sequential at least once;

wherein said driver drives scanning lines by means of a driving waveform having a reset period for resetting a state of said liquid crystal material, a selection period for selecting a final display state of said liquid crystal material, and a maintaining period for establishing the state selected during the selection period;

wherein said driver scans the scanning lines according to the following equation, $$S=a+nk$$

wherein S is scanning lines to be driven on the respective fields in the plural continued scanning lines divided into plural groups according to a number of fields;

a is variable number, an initial value of which is one, and to which one is added each time when S exceeds the number of fields;

n is variable number, an initial value of which is zero, and to which one is added at every time of scanning on one field, and which returns to the initial value every time when S exceeds the number of fields; and k is an integer of not less than 2.

9. A liquid crystal display apparatus, comprising:

a liquid crystal display element composed of a liquid crystal layer and having a plurality of pixels arranged in a matrix pattern, said liquid crystal layer including liquid crystal material having a memory property and exhibiting a cholesteric phase at room temperature; and a driver for dividing one frame into a plurality of fields and interlace-scanning the plurality of fields, wherein said driver drives scanning lines by means of a driving waveform having a field scanning period, said field scanning period comprising, in order, a reset period for resetting a state of liquid crystal material, a selection period for selecting a final display state of the liquid crystal material, and a maintaining period for establishing the state selected at the selection period, said driver configured to start scanning of a next field based on an end timing of a reset period of a previous field, so as to suppress generation of a stripe pattern due to black out.

10. The liquid crystal display apparatus claimed in claim 9, wherein said liquid crystal display element is constituted so that a plurality of liquid crystal layers are laminated, and the liquid crystal layers are scanned by said driver.

11. A liquid crystal display apparatus comprising:

a liquid crystal display element composed of a liquid crystal layer and having a plurality of pixels arranged in a matrix form, said liquid crystal layer including liquid crystal material having a memory property and exhibiting a cholesteric phase at room temperature; and a driver for dividing one frame into at least four fields and interlace-scanning the at least four fields, wherein said driver drives the respective fields composing one frame so that a scanning order of the fields is non-sequential at least once, so as to suppress generation of a stripe pattern due to black out.

12. The liquid crystal display apparatus claimed in claim 11, wherein said driver successively scans odd-numbered lines of the respective fields and then successively scans even-numbered lines.

13. The liquid crystal display apparatus claimed in claim 11, wherein said driver scans scanning lines according to the following equation:

$$S=a+nk,$$

wherein S is a scanning line to be driven on the respective fields in the plural continued scanning lines divided into plural groups according to a number of fields;

a is a variable number, an initial value of which is one, and to which one is added each time when S exceeds the number of fields;

n is a variable number, an initial value of which is zero, and to which one is added at every time of scanning on one field, and which returns to the initial value every time when S exceeds the number of fields; and k is an integer of not less than 2.

14. The liquid crystal display apparatus claimed in claim 11, wherein said driver drives scanning lines by means of a driving waveform including at least a selection period for selecting a final display state of said liquid crystal material and a maintaining period for maintaining the state selected during the selection period.

* * * * *